US009437378B2

(12) United States Patent
Nishino

(10) Patent No.: US 9,437,378 B2
(45) Date of Patent: Sep. 6, 2016

(54) KEYSWITCH DEVICE

(71) Applicant: FUJITSU COMPONENT LIMITED, Tokyo (JP)

(72) Inventor: Takeshi Nishino, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 26 days.

(21) Appl. No.: 14/496,231

(22) Filed: Sep. 25, 2014

(65) Prior Publication Data

US 2015/0107979 A1 Apr. 23, 2015

(30) Foreign Application Priority Data

Oct. 17, 2013 (JP) ..... 2013-216728

(51) Int. Cl.
*H01H 13/70* (2006.01)
*H01H 13/705* (2006.01)
*H01H 3/12* (2006.01)

(52) U.S. Cl.
CPC ..... *H01H 13/705* (2013.01); *H01H 3/125* (2013.01)

(58) Field of Classification Search
CPC ..... H01H 3/125; H01H 13/705
USPC ..... 200/341, 344, 345
See application file for complete search history.

(56) References Cited

U.S. PATENT DOCUMENTS

| | | | | |
|---|---|---|---|---|
| 5,488,210 | A * | 1/1996 | Shigetaka | H01H 3/125 200/344 |
| 5,779,030 | A * | 7/1998 | Ikegami | H01H 3/125 200/341 |
| 6,194,677 | B1 * | 2/2001 | Li | H01H 3/125 200/344 |
| 6,501,038 | B2 | 12/2002 | Hayashi et al. | |
| 8,299,382 | B2 * | 10/2012 | Takemae | H01H 3/125 200/341 |
| 2001/0002647 | A1 * | 6/2001 | Hayashi | H01H 3/125 200/344 |
| 2013/0140162 | A1 * | 6/2013 | Lu | H01H 3/125 200/344 |

FOREIGN PATENT DOCUMENTS

| | | |
|---|---|---|
| JP | 2001-167658 | 6/2001 |
| JP | 2002-260483 | 9/2002 |

* cited by examiner

*Primary Examiner* — Vanessa Girardi
(74) *Attorney, Agent, or Firm* — IPUSA, PLLC

(57) ABSTRACT

A keyswitch device includes a pair of links for supporting a key top, each provided on the support sheet and including a first arm and a second arm, and a frame for supporting the links, provided on the support sheet. Each link includes a rotation shaft provided at a first end and a slide shaft provided at a second end of each of the first arm and the second arm. The rotation shaft is rotatably placed on one of the frame and the key top. The slide shaft is slidably placed in a corresponding one of guide grooves provided on the other of the frame and the key top. A connecting groove is provided in the first arm of at least one of the links. A connecting shaft is provided on the second arm of the other of the links, and is movably placed in the connecting groove.

6 Claims, 16 Drawing Sheets

KEYSWITCH DEVICE

CROSS-REFERENCE TO RELATED APPLICATION

The present application is based upon and claims the benefit of priority of Japanese Patent Application No. 2013-216728, filed on Oct. 17, 2013, the entire contents of which are incorporated herein by reference.

BACKGROUND OF THE INVENTION

1. Field of the Invention

The present invention relates to keyswitch devices.

2. Description of the Related Art

Common notebook or desktop personal computers include a keyboard as an information input device. The keyboard is provided with keyswitches corresponding to letters, characters, etc., to be input. By pressing keyswitches corresponding to letters or characters to be input, it is possible to input predetermined information. Such keyswitches are desired to be reduced in size, easy to operate, and highly reliable.

Reference may be made to Japanese Laid-Open Patent Applications No. 2001-167658 and No. 2002-260483 for related art.

SUMMARY OF THE INVENTION

According to an aspect of the present invention, a keyswitch device includes a pair of links for supporting a key top, each provided on the support sheet and including a first arm and a second arm, and a frame for supporting the links, provided on the support sheet. Each link includes a rotation shaft provided at a first end and a slide shaft provided at a second end of each of the first arm and the second arm. The rotation shaft is rotatably placed on one of the frame and the key top. The slide shaft is slidably placed in a corresponding one of guide grooves provided on the other of the frame and the key top. A connecting groove is provided in the first arm of at least one of the links. A connecting shaft is provided on the second arm of the other of the links, and is movably placed in the connecting groove.

DESCRIPTION OF THE EMBODIMENTS

Figure 1:
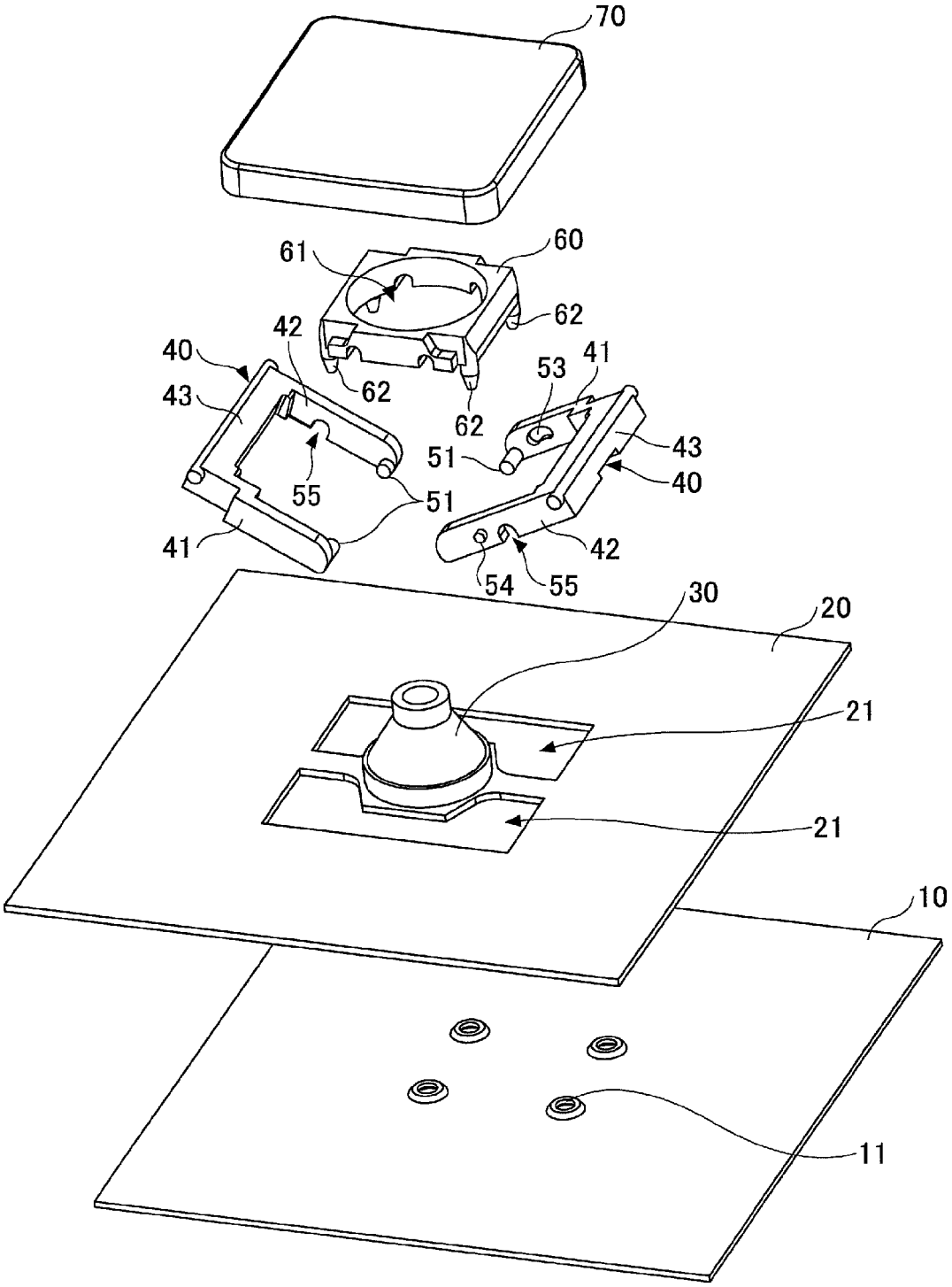
FIG. 1 is an exploded perspective of a keyswitch device according to a first embodiment.

Embodiments of the present invention are described below with reference to the accompanying drawings. In the following, the same members are referred to by the same reference numeral, and are not repetitively described.

[a] First Embodiment

A keyswitch device of a first embodiment is described. FIG. 1 is an exploded perspective of a keyswitch device according to the first embodiment. Referring to FIG. 1, the keyswitch device of the first embodiment includes a support sheet 10, a membrane switch 20, a rubber actuator 30, a pair of links 40, a frame 60, and a key top 70. The membrane switch 20 is provided on the support sheet 10. The rubber actuator 30 and the links 40 are provided on the membrane switch 20. The key top 70 is provided on the links 40.

Four openings 11 for connecting the frame 60 are formed in the support sheet 10. The membrane switch 20 is normally open and is closed when pressed. Through holes 21 for connecting the frame 60 and the support sheet 10 are formed in the membrane switch 20. The rubber actuator 30 is formed of an elastic material such as rubber. The resilience of the rubber actuator 30 returns the key top 70 to its original position before pressing when a finger or the like pressing the key top 70 is released from the key top 70.

Figure 2A:
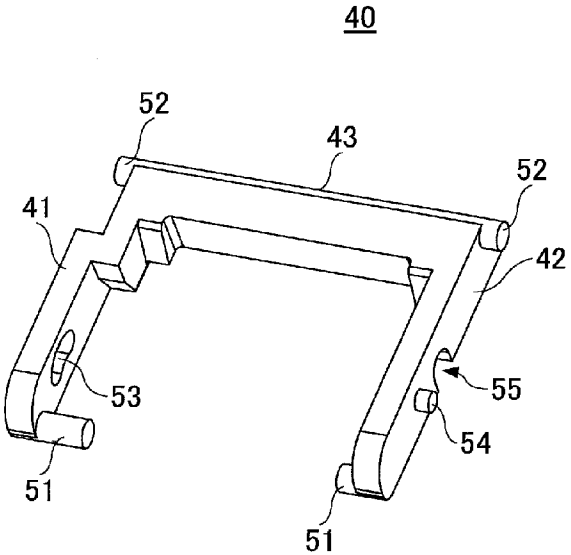
FIGS. 2A, 2B and 2C are perspective views of a link of the keyswitch device according to the first embodiment.
Figure 2B:
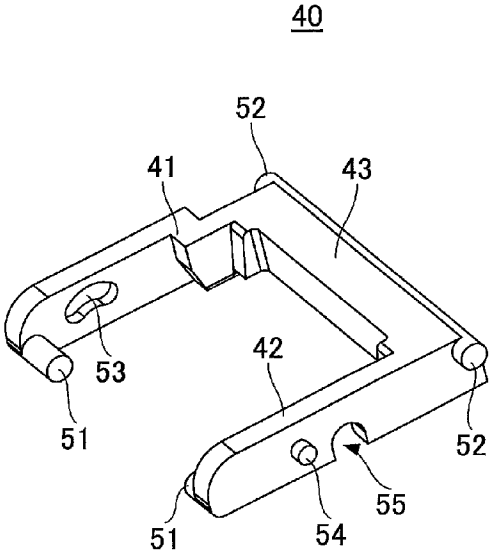
Figure 2C:
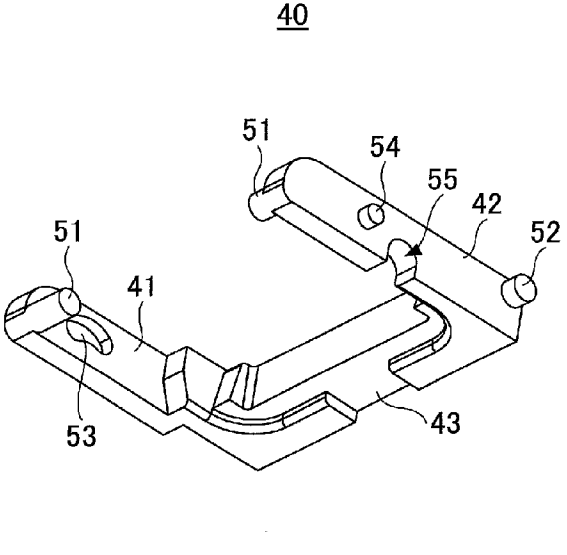

FIGS. 2A, 2B and 2C are perspective views of a link of the keyswitch device according to the first embodiment, taken from different angles. FIGS. 2A and 2B are top-side perspective views and FIG. 2C is a bottom-side perspective view. Referring to FIGS. 2A through 2C, each link 40 has an angular C-letter shape, and includes a pair of arms 41 and 42 and a connecting part 43 that connects the arms 41 and 42.

A rotation shaft 51 projecting inward is provided at a first end of the arm 41 and a first end of the arm 42. A second end of the arm 41 and a second end of the arm 42 are connected by the connecting part 43. A slide shaft 52 projecting outward is provided at each end of the connecting part 43, that is, near each of portions of the connecting part 43 to which the arms 41 and 42 are connected.

A connecting groove 53 having an elongated shape is formed in the middle of the arm 41. A connecting shaft 54 projecting outward is provided in the middle of the arm 42. Furthermore, part of the arm 42 is depressed to form a hollow 55.

Figure 3:
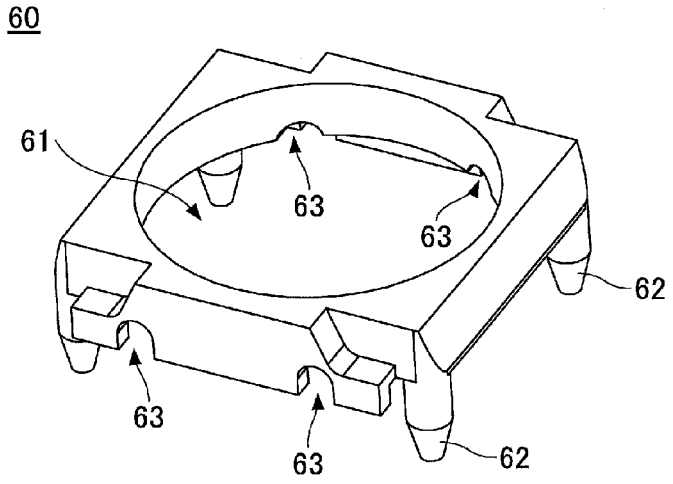
FIG. 3 is a perspective view of a frame of the keyswitch device according to the first embodiment.

FIG. 3 is a perspective view of a frame of the keyswitch device according to the first embodiment. Referring to FIG. 3, a through hole 61 is formed in the center of the frame 60. Part of the rubber actuator 30 enters the through hole 61. Projections 62 for connecting the frame 60 to the support sheet 10 are provided at the four corners of the frame 60 on its bottom side on which the frame 60 is connected to the support sheet 10. Four depressions are formed in the frame 60 on its bottom side to form bearings 63.

Figure 4:
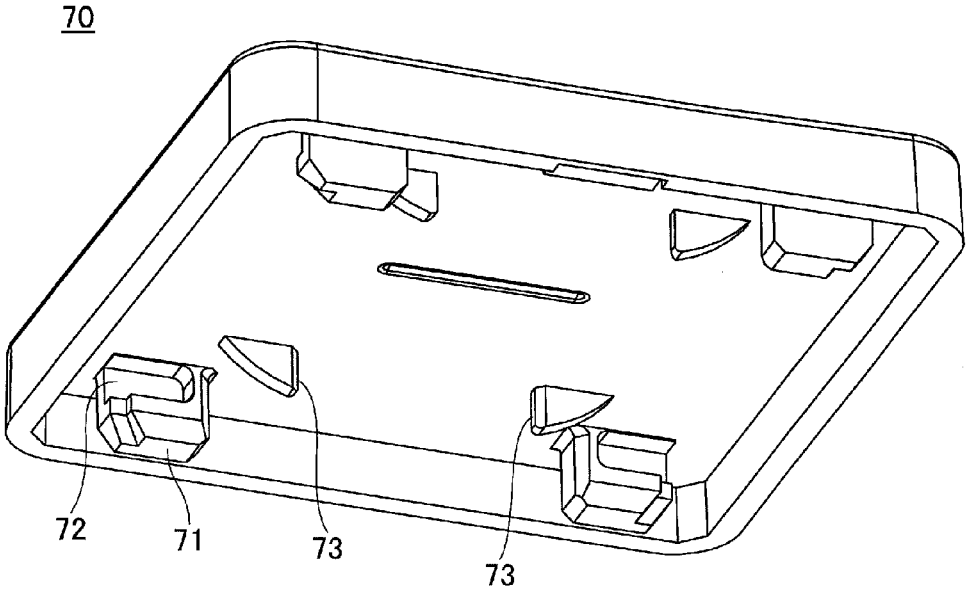
FIG. 4 is a perspective view of a key top of the keyswitch device according to the first embodiment.

FIG. 4 is a perspective view of a key top of the keyswitch device according to the first embodiment. Referring to FIG. 4, the key top 70 has four guides 71 provided on its bottom surface opposite to its top surface to be touched by a finger or the like. A guide groove 72 that extends parallel to the top surface of the key top 70 is provided in each guide 71. Each guide groove 72 is open toward outside. Four projections 73 are provided on the bottom surface of the key top 70. The projections 73 are provided so as to restrict the position of the key top 70 relative to the links 40, so that the key top 70 is not displaced.

According to this embodiment, the links 40, the frame 60, and the key top 70 are formed of a resin material such as plastic.

Figure 5:
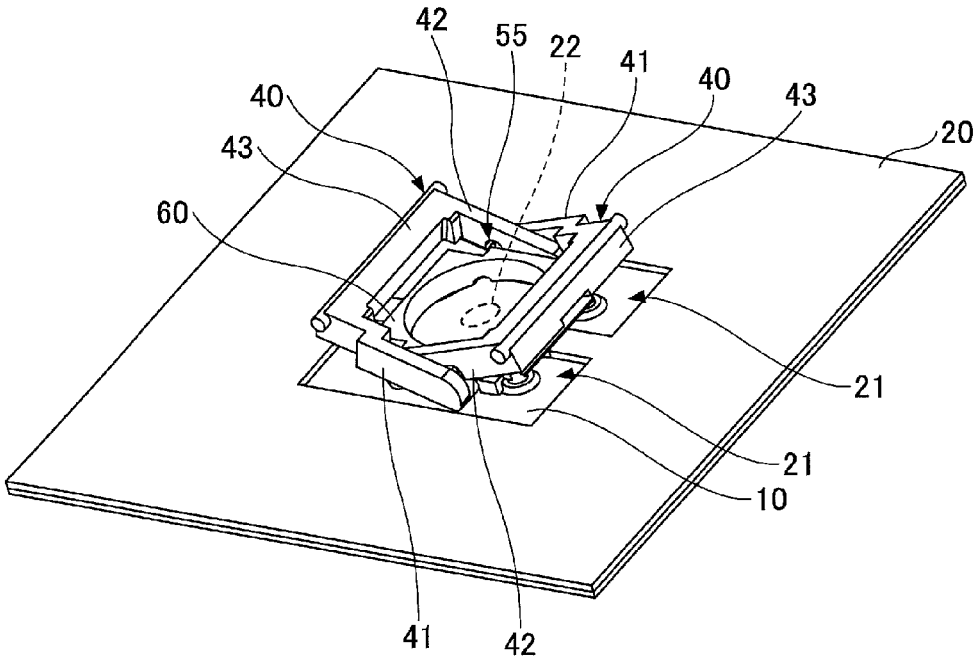
FIG. 5 is a perspective view of the keyswitch device being assembled according to the first embodiment.
Figure 6:
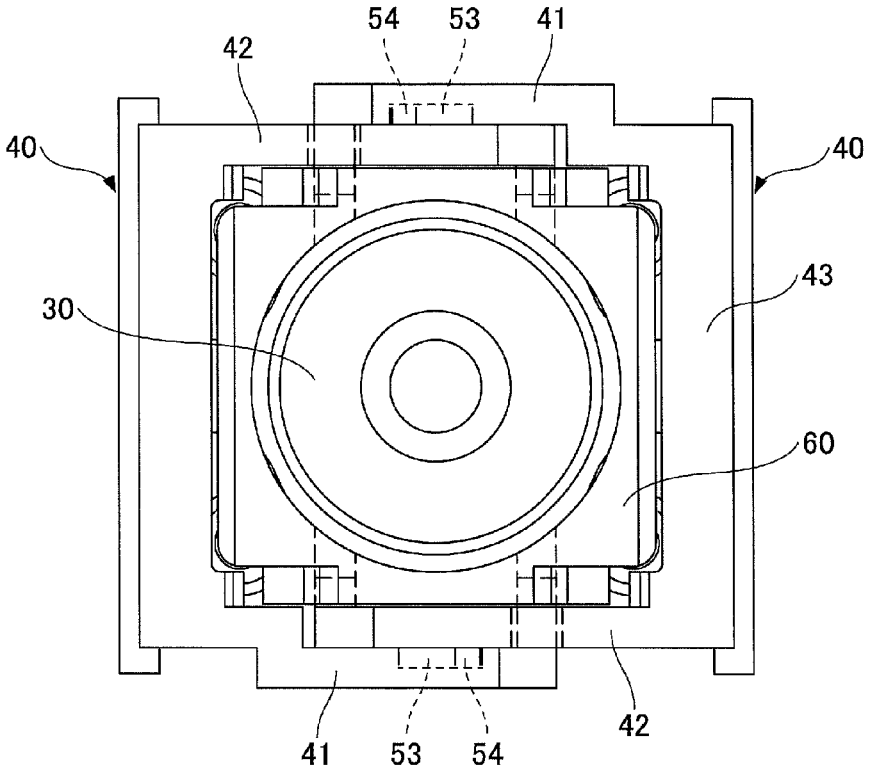
FIG. 6 is a plan view of the keyswitch device being assembled according to the first embodiment.

FIGS. 5 and 6 are diagrams illustrating states of the keyswitch device being assembled according to the first embodiment. FIG. 5 is a perspective view of the keyswitch device in the state where the membrane switch 20 is provided on the support sheet 10, and the links 40 and the frame 60 are provided on the membrane switch 20. FIG. 6 is a plan view of the keyswitch device in the state where the rubber actuator 30 is further provided on the membrane switch 20. A contact 22 that serves as a switch is provided in the center, that is, at a position corresponding to the through hole 61 of the frame 60, of the membrane switch 20.

The links 40 are placed with the arm 41 of each link 40 being positioned outside the arm 42 of the other link 40. In this state, the connecting shaft 54 of the arm 42 of each link 40 is inside the connecting groove 53 of the arm 41 of the other link 40. Accordingly, a pair of the links 40 are placed with the arm 41 of each link 40 crossing the arm 42 of the other link 40. In this state, the connecting shaft 54 of the arm 42 of each link 40 is freely movable inside the connecting groove 53 of the arm 41 of the other link 40. The hollow 55 provided in the arm 42 of each link 40 is formed so as to prevent the arm 42 from contacting the rotation shaft 51 provided on the arm 41 of the other link 40 when the key top 70 is pressed.

In the above-described state, the links 40 are connected to the support sheet 10 by the frame 60. The frame 60 is placed on the support sheet 10 with the projections 62 being inserted in the corresponding openings 11 formed in the support sheet 10 through the through holes 21 of the membrane switch 20. Furthermore, the rotation shafts 51 of the links 40 are provided in the corresponding bearings 63 of the frame 60. As a result, the links 40 are fixed with their respective rotation shafts 51 being rotatable in the bearings 63.

The rubber actuator 30 is placed inside the through hole 61 of the frame 60. The key top 70 is placed over the rubber actuator 30 and the links 40. The key top 70 is placed on the links 40 with the slide shafts 52 of each link 40 being inside the corresponding guide grooves 72 provided on the bottom surface of the key top 70.

Next, an operation when a keyswitch device according to this embodiment is pressed is described with reference to FIGS. 7, 8A, 8B, 9A and 9B.

Figure 7:
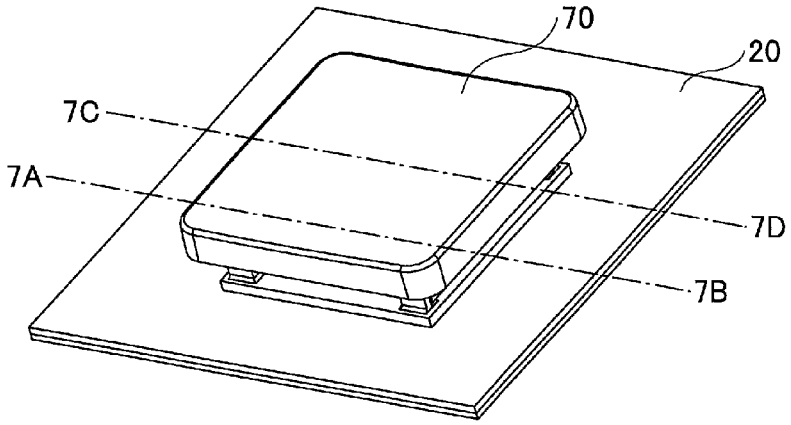
FIG. 7 is a perspective view of the keyswitch device according to the first embodiment.
Figure 8A:
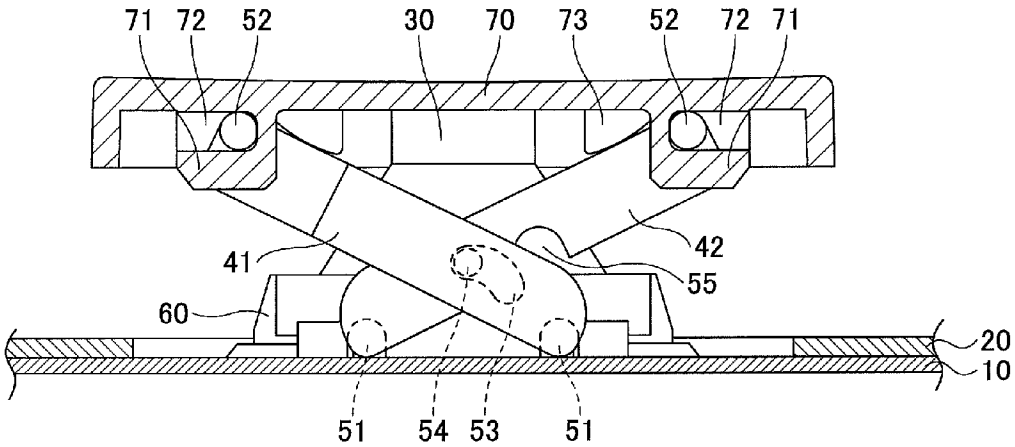
FIGS. 8A and 8B are cross-sectional views of the keyswitch device according to the first embodiment.
Figure 8B:
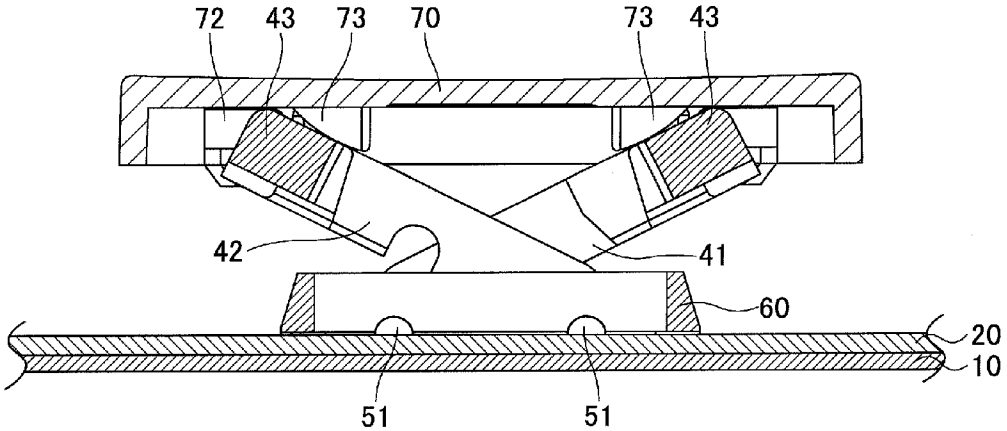

FIG. 7 is a perspective view of the keyswitch device according to the first embodiment. FIGS. 8A and 8B are cross-sectional views of the keyswitch device when the keyswitch device is not pressed. FIG. 8A is a cross-sectional view taken along a plane including one-dot chain line 7A-7B in FIG. 7. FIG. 8B is a cross-sectional view taken along a plane including one-dot chain line 7C-7D in FIG. 7. In FIG. 8B, the rubber actuator 30 is omitted for convenience.

When the keyswitch device is not pressed, the key top 70 is raised by the rubber actuator 30. In this state, the connecting shaft 54 of the arm 42 of each link 40 is inside the connecting groove 53 provided in the arm 41 of the other link 40. In FIG. 8A, the connecting shaft 54 is positioned on the left side inside the corresponding connecting groove 53.

By pressing the top surface of the key top 70 of the keyswitch device, the key top 70 moves downward, so that the links 40 move. According to this embodiment, at this point, the slide shafts 52 of the links 40 move outward inside the corresponding guide grooves 72 of the key top 70. At the same time, the connecting shaft 54 of the arm 42 of each link 40 moves inside the connecting groove 53 in the arm 41 of the other link 40.

Figure 9A:
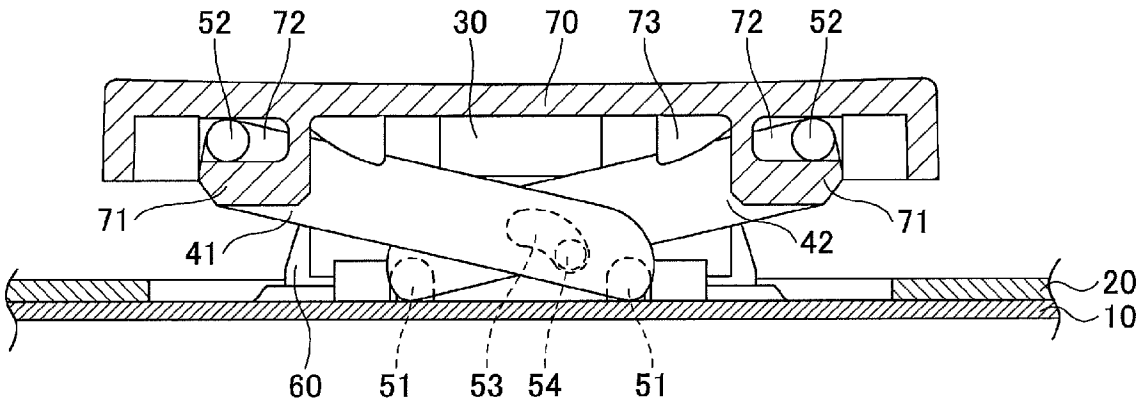
FIGS. 9A and 9B are cross-sectional views of the keyswitch device according to the first embodiment.
Figure 9B:
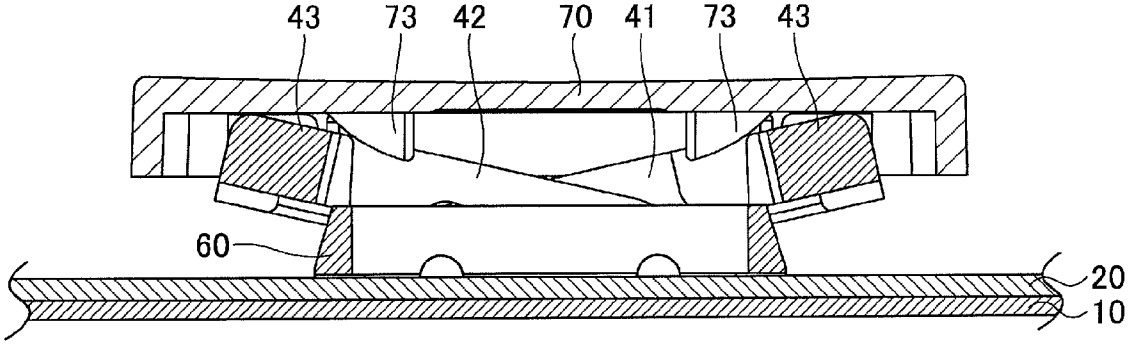

FIGS. 9A and 9B are cross-sectional views of the keyswitch device when the keyswitch device is not pressed. FIG. 9A is a cross-sectional view taken along a plane including one-dot chain line 7A-7B in FIG. 7. FIG. 9B is a cross-sectional view taken along a plane including one-dot chain line 7C-7D in FIG. 7. In FIG. 9B, the rubber actuator 30 is omitted for convenience.

As illustrated in FIGS. 9A and 9B, the connecting shaft 54 of the arm 42 of each link 40 moves rightward inside the connecting groove 53 in the arm 41 of the other link 40. At this point, the rotation shafts 51 of the links 40 rotate in the bearings 63 provided in the frame 60 without moving.

According to the keyswitch device of this embodiment, no gears are formed in the links 40. Therefore, there is no breakage of gears, so that the reliability of the keyswitch device is increased. Furthermore, the connecting shaft 54 of the arm 42 of each link 40 moves inside the connecting groove 53 in the arm 41 of the other link 40. Therefore, the movements of the links 40 are smooth, so that a force necessary to press the key top 70 does not vary. Accordingly, it is possible to smoothly operate the keyswitch device.

The rotation shafts 51 of the links 40 fixed to the support sheet 10 by the frame 60 rotate without moving, and the slide shafts 52 of the links 40 move outward inside the corresponding guide grooves 72 of the key top 70. Therefore, the key top 70 is prevented from sliding, so that it is possible to press the key top 70 stably.

[b] Second Embodiment

Figure 10:
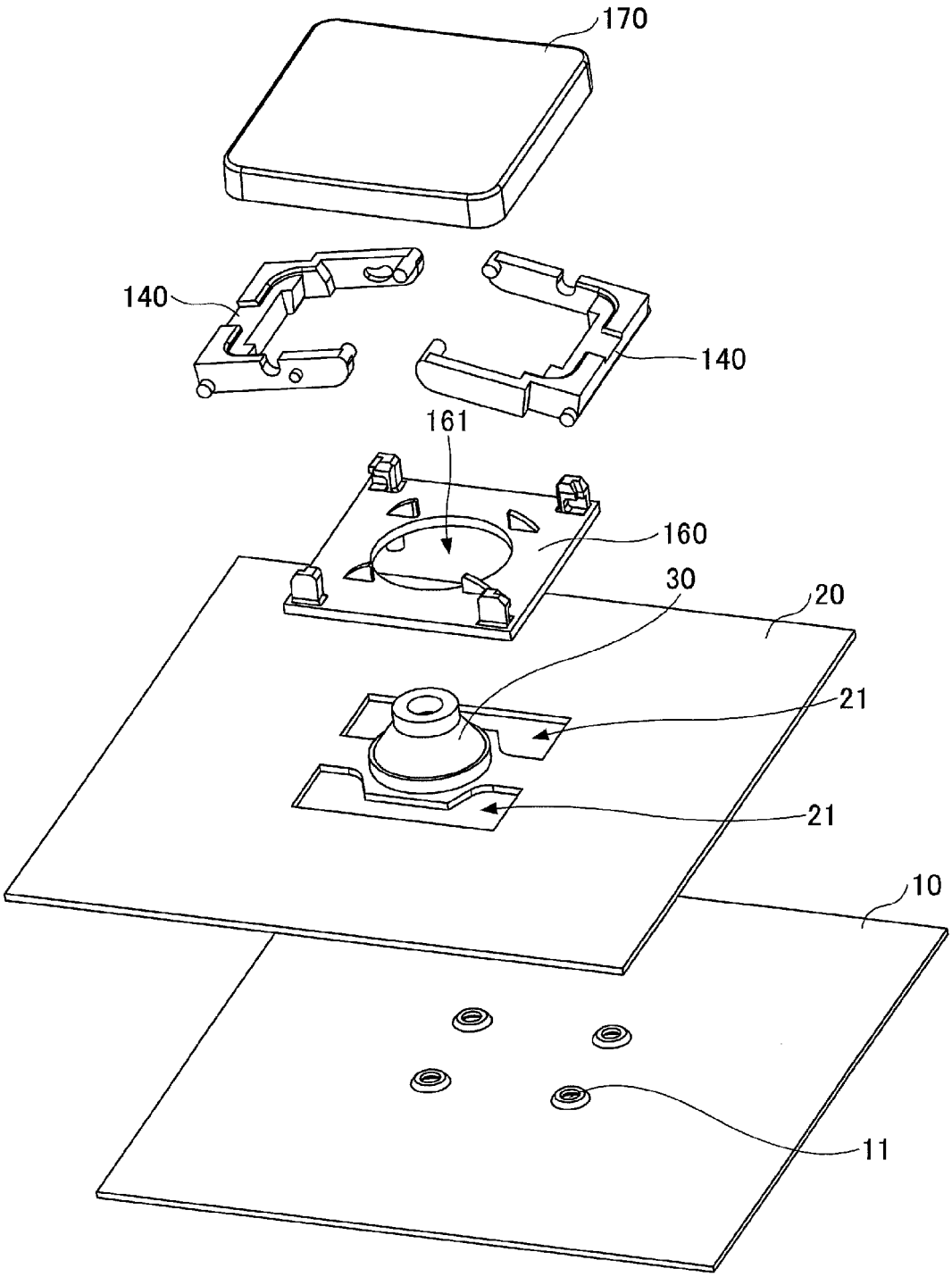
FIG. 10 is an exploded perspective view of a keyswitch device according to the second embodiment.

Next, a second embodiment is described. FIG. 10 is an exploded perspective view of a keyswitch device according to the second embodiment. Referring to FIG. 10, the keyswitch device of this embodiment includes the support sheet 10, the membrane switch 20, the rubber actuator 30, a pair of links 140, a frame 160, and a key top 170. The membrane switch 20 is provided on the support sheet 10. The rubber actuator 30 and the links 140 are provided on the membrane switch 20. The key top 170 is provided on the links 140.

The four openings 11 for connecting the frame 160 are formed in the support sheet 10. The through holes 21 for connecting the frame 160 and the support sheet 10 are formed in the membrane switch 20. The rubber actuator 30 is formed of an elastic material such as rubber. The resilience of the rubber actuator 30 returns the key top 170 to its original position before pressing when a finger or the like pressing the key top 170 is released from the key top1 170.

Figure 11A:
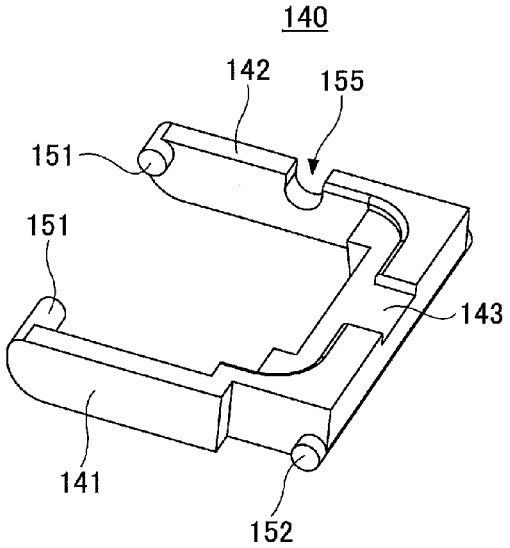
FIGS. 11A and 11B are perspective views of a link of the keyswitch device according to the second embodiment.
Figure 11B:
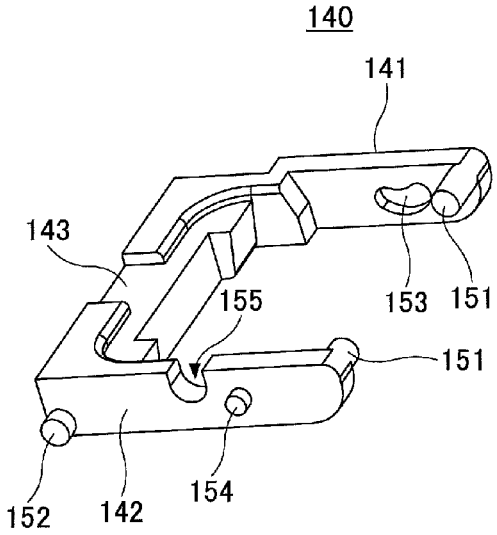

FIGS. 11A and 11B are perspective views of a link of the keyswitch device according to the second embodiment, taken from different angles. FIG. 11A is a perspective view from one arm side, and FIG. 11B is a perspective view from the other arm side. Referring to FIGS. 11A and 11B, each link 140 has an angular C-letter shape, and includes a pair of arms 141 and 142 and a connecting part 143 that connects the arms 141 and 142.

A rotation shaft 151 projecting inward is provided at a first end of the arm 141 and a first end of the arm 142. A second end of the arm 141 and a second end of the arm 142 are connected by the connecting part 143. A slide shaft 152 projecting outward is provided at each end of the connecting part 43.

A connecting groove 153 having an elongated shape is formed in the middle of the arm 141. A connecting shaft 154 projecting outward is provided in the middle of the arm 142. Furthermore, part of the arm 142 is depressed to form a hollow 155.

Figure 12:
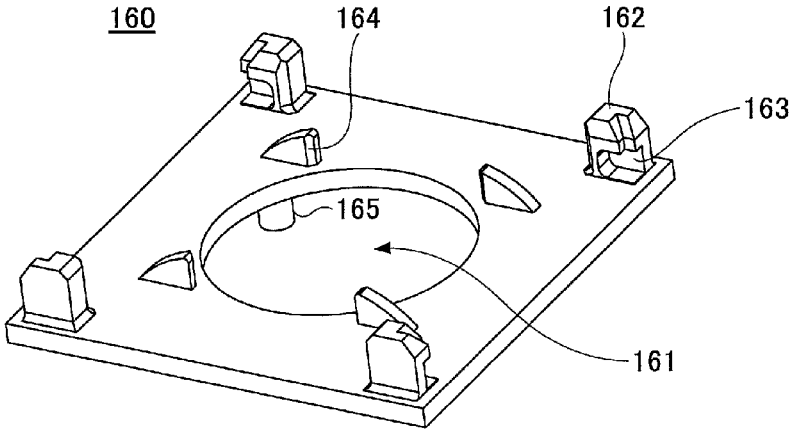
FIG. 12 is a perspective view of a frame of the keyswitch device according to the second embodiment.

FIG. 12 is a perspective view of a frame of the keyswitch device according to the second embodiment. Referring to FIG. 12, a through hole 161 is formed in the center of the frame 160. Part of the rubber actuator 30 enters the through hole 161. Projections 165 (only one of which is illustrated in FIG. 12) for connecting the frame 160 to the support sheet 10 are provided at the four corners of the frame 160 on its bottom side on which the frame 160 is connected to the support sheet 10. Four guides 162 are provided on a top surface of the frame 160. A guide groove 163 that extends parallel to a top surface of the key top 170 is provided in each guide 162. Each guide groove 163 is open toward outside. Furthermore, four projections 164 are provided on the top surface of the frame 160.

Figure 13:
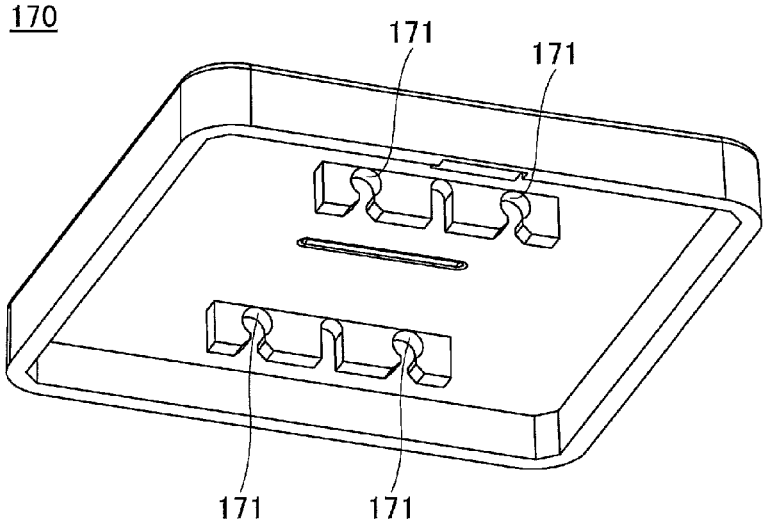
FIG. 13 is a perspective view of a key top of the keyswitch device according to the second embodiment.

FIG. 13 is a perspective view of a key top of the keyswitch device according to the second embodiment. Referring to FIG. 13, four bearings 171 each formed like a hollow are provided on a bottom surface of the key top 170 opposite to its top surface to be touched by a finger or the like.

According to this embodiment, the links 140, the frame 160, and the key top 170 are formed of a resin material such as plastic.

Figure 14:
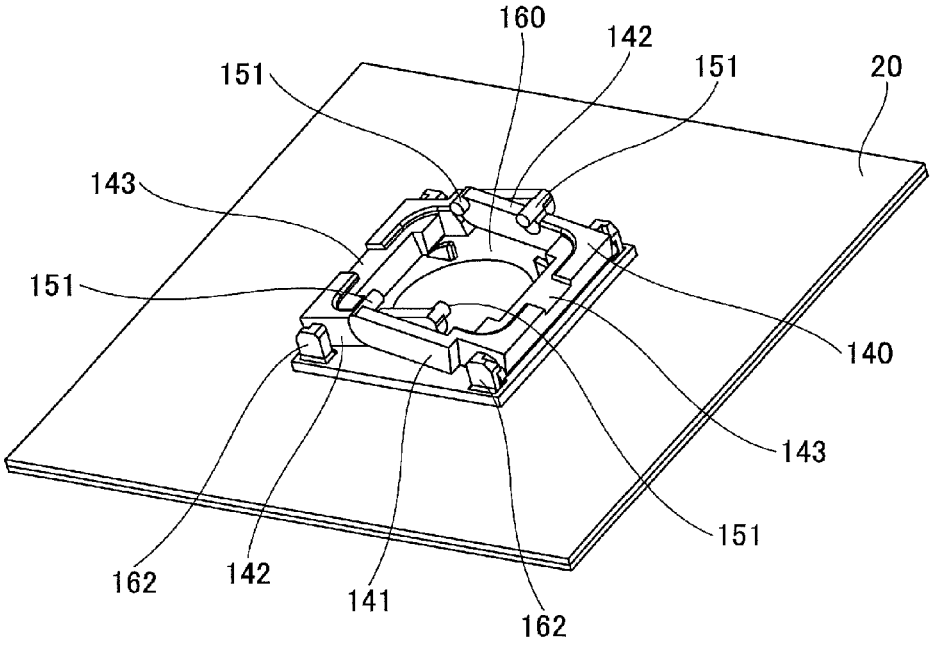
FIG. 14 is a perspective view of the keyswitch device in the process of assembly according to the second embodiment.

FIG. 14 is a diagram illustrating a state of the keyswitch device during assembly according to the second embodiment. FIG. 14 is a perspective view of the keyswitch device in the state where the membrane switch 20 is provided on the support sheet 10, and the links 140 and the frame 160 are provided on the membrane switch 20.

The links 140 are placed with the arm 141 of each link 140 being positioned outside the arm 142 of the other link 140. In this state, the connecting shaft 154 of the arm 142 of each link 140 is inside the connecting groove 153 of the arm 141 of the other link 140. Accordingly, the links 140 are placed with the arm 141 of each link 140 crossing the arm 142 of the other link 140. In this state, the connecting shaft 154 of the arm 42 of each link 140 is freely movable inside the connecting groove 153 of the arm 141 of the other link 140. The hollow 155 provided in the arm 142 of each link 140 is formed so as to prevent the arm 142 from contacting the rotation shaft 151 provided on the arm 141 of the other link 140 when the key top 170 is pressed.

The frame 160 is placed on the support sheet 10 with the slide shafts 152 provided at both ends of the connecting parts 143 of the links 140 being inside the corresponding guide grooves 163 in the guides 162 provided on the frame 160.

Furthermore, the key top 170 is placed on the links 140 with the rotation shafts 151 of the links 140 being inside the corresponding bearings 171 provided on the bottom surface of the key top 170. As a result, the links 140 are fixed with their respective rotation shafts 151 being rotatable in the bearings 171.

In the above-described state, the links 140 are connected to the frame 160 and the key top 170.

The links 140 are placed on the support sheet 10 with the projections 165 provided on the frame 160 being inserted in the corresponding openings 11 formed in the support sheet 10 through the through holes 21 of the membrane switch 20.

The rubber actuator 30 is placed inside the through hole 161 of the frame 160. The key top 170 is placed on the rubber actuator 30 and the links 140.

Next, a state of a pressed keyswitch device is described with reference to FIGS. 15, 16A and 16B.

Figure 15:
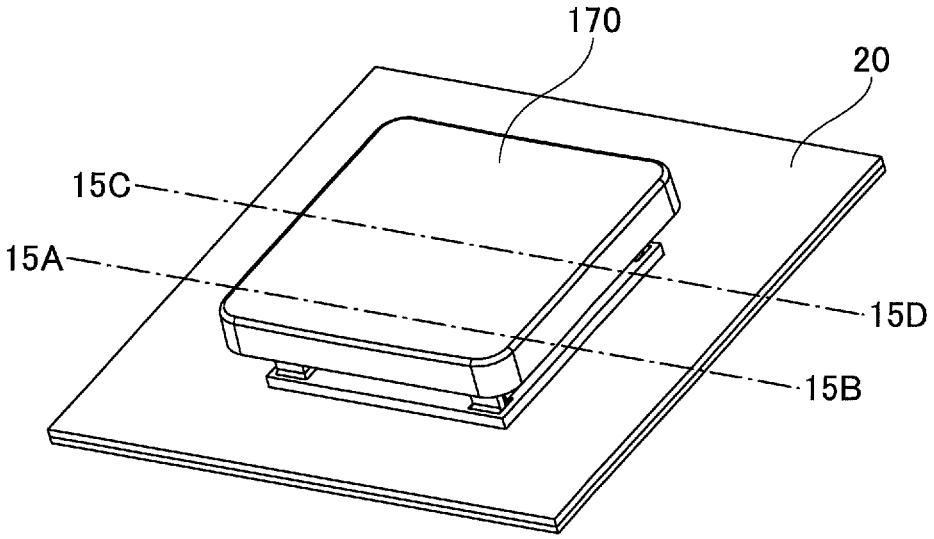
FIG. 15 is a perspective view of the keyswitch device according to the second embodiment.

FIG. 15 is a perspective view of the keyswitch device according to the second embodiment. FIG. 16A is a cross-sectional view taken along a plane including one-dot chain line 15A-15B in FIG. 15. FIG. 16B is a cross-sectional view taken along a plane including one-dot chain line 15C-15D in FIG. 15. When the keyswitch device is not pressed, the key top 170 is raised by the rubber actuator 30. In this state, although not illustrated in the drawings, the connecting shaft 154 of the arm 142 of each link 140 is inside the connecting groove 153 provided in the arm 141 of the other link 140, and the connecting shaft 154 is positioned on one side inside the corresponding connecting groove 153.

Figure 16A:
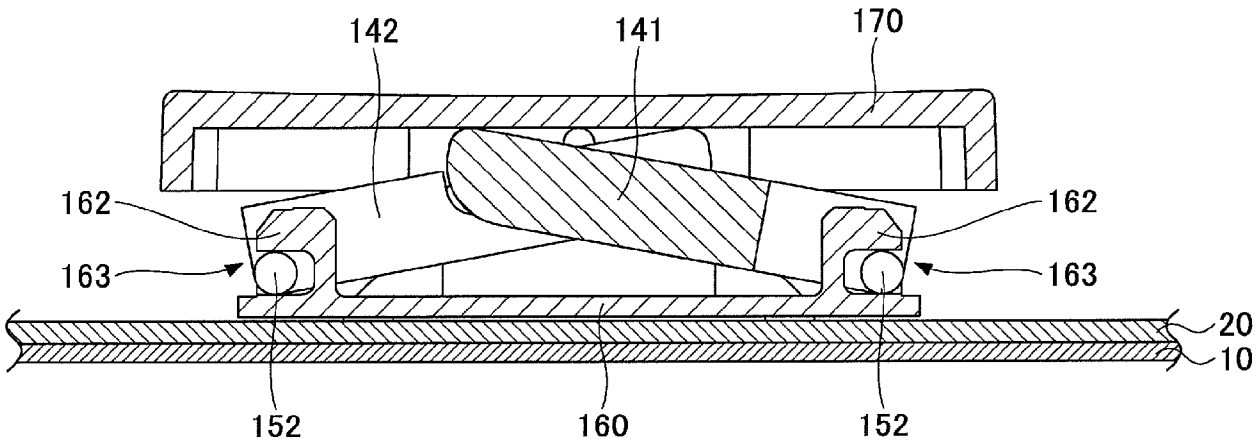
FIGS. 16A and 16B are cross-sectional views of the keyswitch device according to the second embodiment.
Figure 16B:
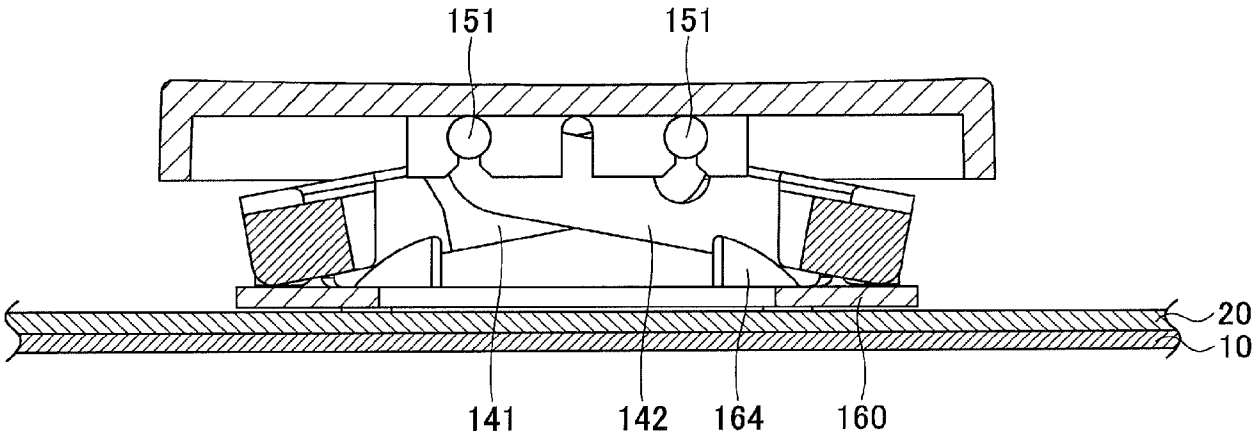

According to the keyswitch device of this embodiment, by pressing the top surface of the key top 170, the key top 170 moves downward, so that the links 140 move as illustrated in FIGS. 16A and 16B. As a result, the slide shafts 152 of the links 140 move outward inside the corresponding guide grooves 163 of the frame 160. At the same time, the connecting shaft 154 of the arm 142 of each link 140 moves inside the connecting groove 153 in the arm 141 of the other link 140.

That is, the connecting shaft 154 of the arm 142 of each link 140 moves to the other side inside the connecting groove 153 in the arm 141 of the other link 140. At this point, the rotation shafts 151 of the links 140 rotate in the bearings 171 provided on the key top 170 without moving.

In other respects than those described above, the second embodiment may be the same as the first embodiment.

[c] Third Embodiment

Figure 17:
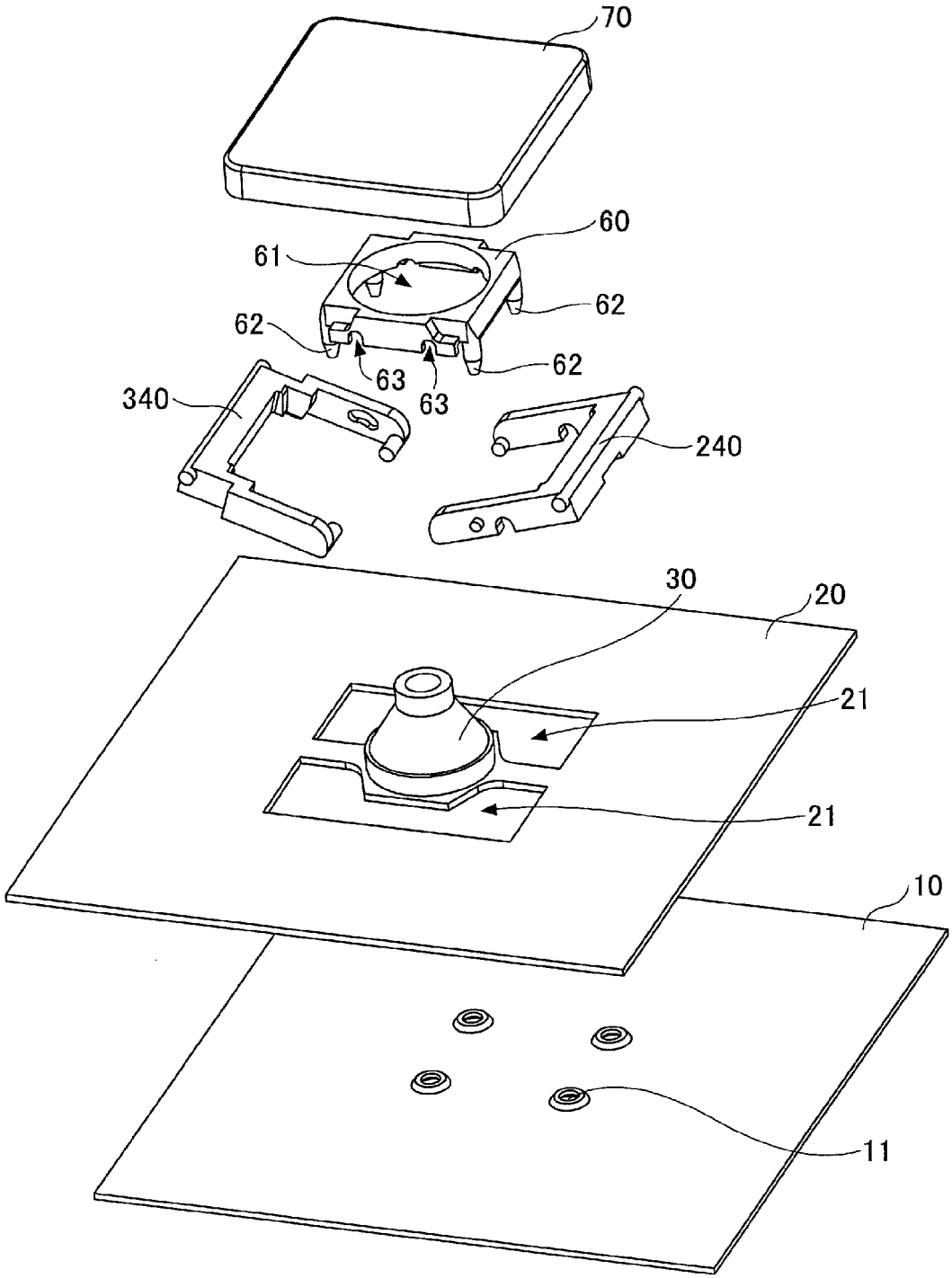
FIG. 17 is an exploded perspective view of a keyswitch device according to a third embodiment.

Next, a third embodiment is described. FIG. 17 is an exploded perspective view of a keyswitch device according to the third embodiment. Referring to FIG. 17, the keyswitch device includes the support sheet 10, the membrane switch 20, the rubber actuator 30, a first link 240, a second link 340, the frame 60, and the key top 70. The membrane switch 20, the rubber actuator 30, the first and second links 240 and 340, and the frame 60 are provided on the support sheet 10. Furthermore, the key top 70 is provided on the first and second links 240 and 340.

Figure 18A:
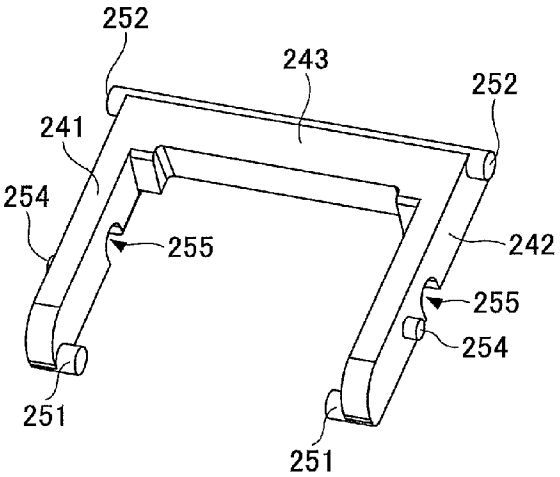
FIGS. 18A, 18B and 18C are perspective views of a first link of the keyswitch device according to the third embodiment.
Figure 18B:
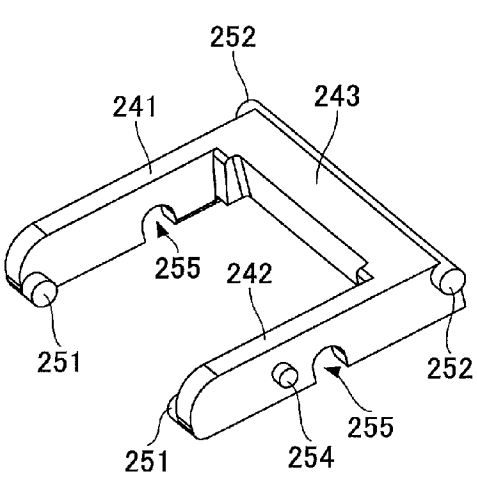
Figure 18C:
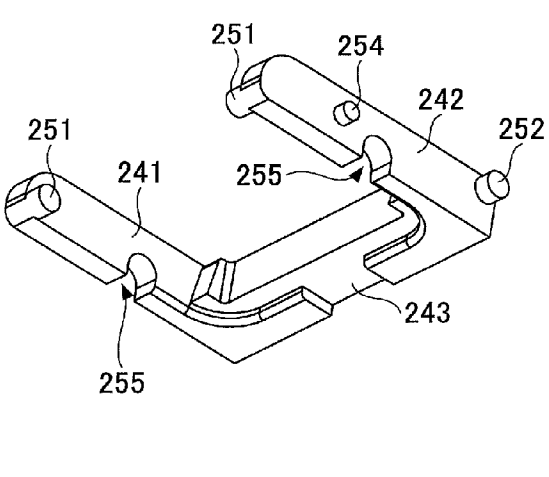

FIGS. 18A, 18B and 18C are perspective views of a first link of the keyswitch device according to the third embodiment, taken from different angles. FIGS. 18A and 18B are top-side perspective views and FIG. 18C is a bottom-side perspective view. Referring to FIGS. 18A through 18C, the first link 240 has an angular C-letter shape, and includes a pair of arms 241 and 242 and a connecting part 243 that connects the arms 241 and 242.

In the first link 240, a rotation shaft 251 projecting inward is provided at a first end of the arm 241 and a first end of the arm 242. A second end of the arm 241 and a second end of the arm 242 are connected by the connecting part 243. A slide shaft 252 projecting outward is provided at each end of the connecting part 243, that is, near each of portions of the connecting part 243 to which the arms 241 and 242 are connected.

A connecting shaft 254 projecting outward is provided in the middle of each of the arms 241 and 242. Furthermore, part of each of the arms 241 and 242 is depressed to form a hollow 255.

Figure 19A:
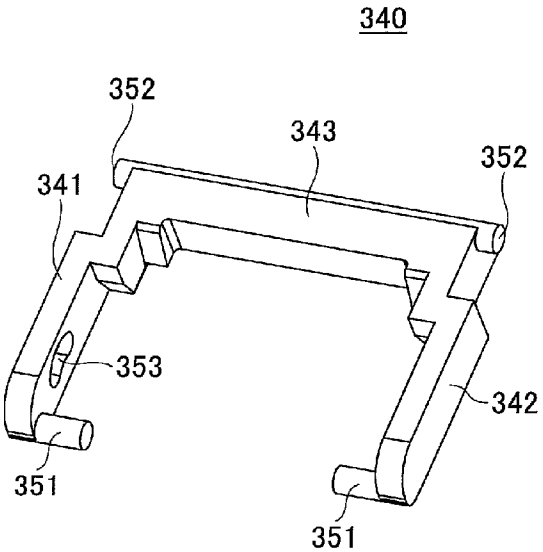
FIGS. 19A, 19B and 19C are perspective views of a second link of the keyswitch device according to the third embodiment.
Figure 19B:
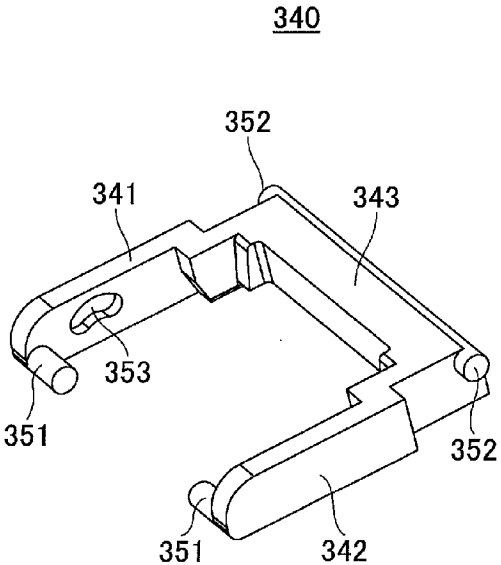
Figure 19C:
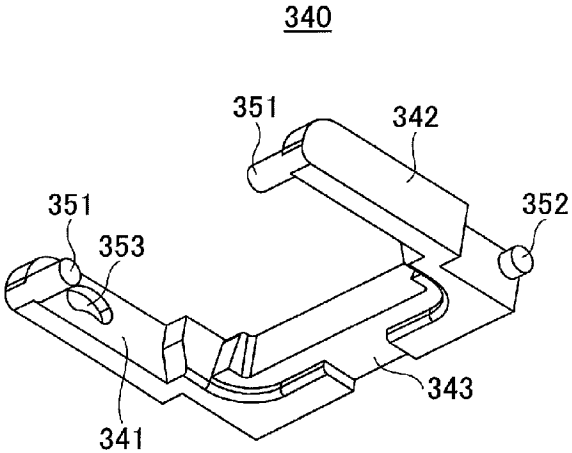

FIGS. 19A, 19B and 19C are perspective views of a second link of the keyswitch device according to the third embodiment, taken from different angles. FIGS. 19A and 19B are top-side perspective views and FIG. 19C is a bottom-side perspective view. Referring to FIGS. 19A through 19C, the second link 340 has an angular C-letter shape, and includes a pair of arms 341 and 342 and a connecting part 343 that connects the arms 341 and 342.

In the second link 340, a rotation shaft 351 projecting inward is provided at a first end of the arm 341 and a first end of the arm 342. A second end of the arm 341 and a second end of the arm 342 are connected by the connecting part 343. A slide shaft 352 projecting outward is provided at each end of the connecting part 343, that is, near each of portions of the connecting part 343 to which the arms 341 and 342 are connected.

A connecting groove 353 having an elongated shape is formed in the middle of each of the arms 341 and 342.

Figure 20:
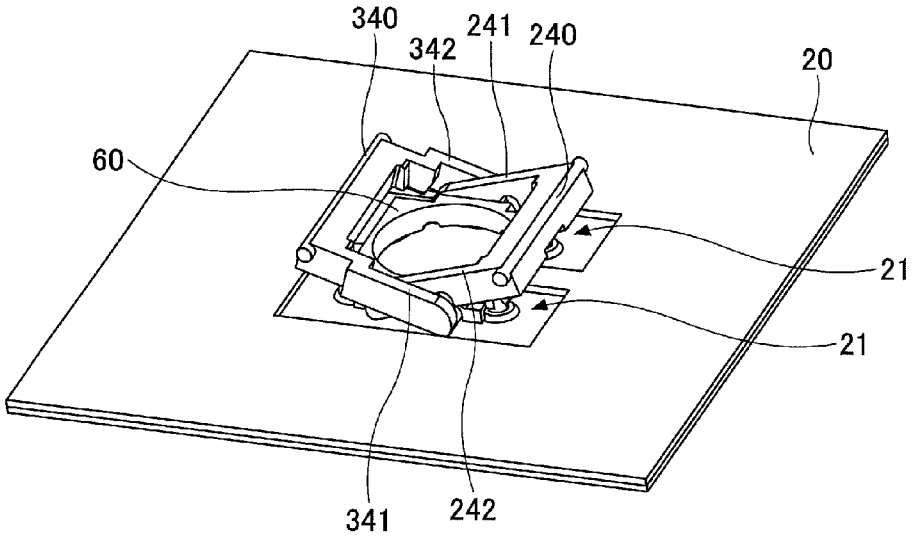
FIG. 20 is a perspective view of the keyswitch device being assembled according to the third embodiment.
Figure 21:
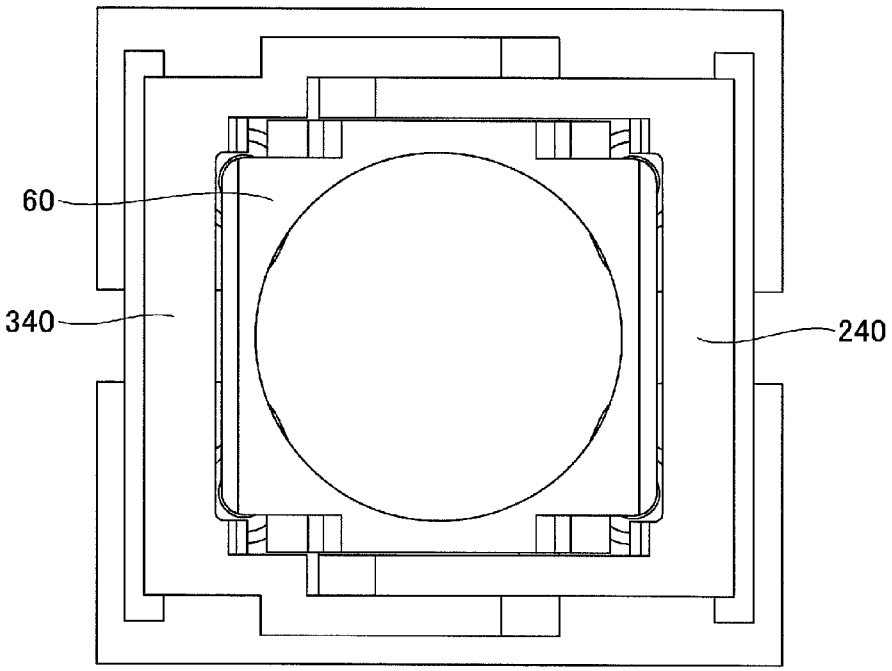
FIG. 21 is a plan view of the keyswitch device being assembled according to the third embodiment.

FIGS. 20 and 21 are diagrams illustrating states of the keyswitch device according to the third embodiment being assembled. FIG. 20 is a perspective view of the keyswitch device in the state where the membrane switch 20 is provided on the support sheet 10, and the first and second links 240 and 340 and the frame 60 are provided on the membrane switch 20. FIG. 21 is a plan view of the keyswitch device.

The first and second links 240 and 340 are placed with the arms 241 and 242 of the first link 240 being inside the arms 341 and 342 of the second link 340. In this state, the connecting shafts 254 of the arms 241 and 242 of the first link 240 are inside the connecting grooves 353 of the arms 341 and 342 of the second link 340.

Accordingly, the first and second links 240 and 340 are placed with the arm 241 of the first link 240 crossing the arm 342 of the second link 340 and the arm 242 of the first link 240 crossing the arm 341 of the second link 340. In this state, the connecting shafts 254 of the arms 241 and 242 of the first link 240 are freely movable inside the connecting grooves 353 of the arms 341 and 342 of the second link 340.

The hollow 255 provided in the arm 241 of the first link 240 is formed so as to prevent the arm 241 from contacting the rotation shaft 351 provided on the arm 342 of the second link 340 when the key top 70 is pressed. Likewise, the hollow 255 provided in the arm 242 of the first link 240 is formed so as to prevent the arm 242 from contacting the rotation shaft 351 provided on the arm 341 of the second link 340 when the key top 70 is pressed.

In the above-described state, the first and second links 240 and 340 are connected to the support sheet 10 by the frame 60. The first and second links 240 and 340 are placed with the projections 62 provided on the frame 60 being inserted in the corresponding openings 11 formed in the support sheet 10 through the through holes 21 of the membrane switch 20. Furthermore, the rotation shafts 251 of the first link 240 and the rotation shafts 351 of the second link 340 are in the corresponding bearings 63 of the frame 60. As a result, the first and second links 240 and 340 are fixed with the rotation shafts 251 and 351 being rotatable in the bearings 63.

The slide shafts 252 provided at both ends of the connecting part 243 of the first link 240 and the slide shafts 352 provided at both ends of the connecting part 343 of the second link 340 are inside the corresponding guide grooves 72 in the guides 71 provided on the bottom surface of the key top 70.

In other respects than those described above, the third embodiment may be the same as the first embodiment. Furthermore, the third embodiment is applicable to the second embodiment.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. A keyswitch device has been described above based on one or more embodiments of the present invention. It should be understood, however, that the various changes, substitutions, and alterations could be made hereto without departing from the spirit and scope of the invention.

What is claimed is:

1. A keyswitch device, comprising:

a support sheet;

a key top;

a pair of links for supporting the key top, each provided on the support sheet, wherein each of the links includes a first arm and a second arm; and a frame for supporting the links, provided on the support sheet, wherein each link includes a rotation shaft provided at a first end of each of the first arm and the second arm, the rotation shaft being rotatably placed on one of the frame and the key top, wherein each link includes a slide shaft provided at a second end of each of the first and second arms, the slide shaft being slidably placed in a corresponding one of guide grooves provided on the other of the frame and the key top, and wherein a connecting groove is provided in the first arm of each of the links at a position between the first end and the second end of the first arm, and a connecting shaft is provided on the second arm of each of the links at a position between the first end and the second end of the second arm, the connecting shaft being movably placed in the connecting groove.

2. The keyswitch device as claimed in claim 1, wherein the rotation shaft is rotatably placed on the frame and the slide shaft is slidably placed in the corresponding one of the guide grooves provided on a first surface of the key top facing the support sheet, and when a second surface of the key top opposite to the first surface is pressed, the slide shaft moves inside the corresponding one of the guide grooves, and the connecting shaft moves inside the connecting groove.

3. The keyswitch device as claimed in claim 1, wherein each link further includes a connecting part that connects the second ends of the first and second arms.

4. The keyswitch device as claimed in claim 1, wherein the rotation shaft is rotatably placed on a first surface of the key top facing the support sheet and the slide shaft is slidably placed in the corresponding one of the guide grooves provided on the frame, and when a second surface of the key top opposite to the first surface is pressed, the slide shaft moves inside the corresponding one of the guide grooves, and the connecting shaft moves inside the connecting groove.

5. A keyswitch device, comprising:

a support sheet;

a key top;

a pair of links for supporting the key top, each provided on the support sheet, wherein each of the links includes a first arm and a second arm;

a frame for supporting the links, provided on the support sheet; and a membrane switch including a contact part, wherein each link includes a rotation shaft provided at a first end of each of the first arm and the second arm, the rotation shaft being rotatably placed on one of the frame and the key top, wherein each link includes a slide shaft provided at a second end of each of the first and second arms, the slide shaft being slidably placed in a corresponding one of guide grooves provided on the other of the frame and the key top, wherein a connecting groove is provided in the first arm of at least one of the links at a position between the first end and the second end of the first arm, and a connecting shaft is provided on the second arm of the other of the links at a position between the first end and the second end of the second arm, the connecting shaft being movably placed in the connecting groove, wherein the membrane switch is provided between the support sheet and the frame, and wherein the support sheet and the frame are connected through a first through hole formed in the membrane switch.

6. The keyswitch device as claimed in claim 5, further comprising:

an actuator formed of an elastic material, wherein a second through hole is formed in a part of the frame positioned above the contact part, and wherein the actuator is provided between the membrane switch and the key top in the second through hole.

* * * * *